US007767023B2

(12) United States Patent
Burgess

(10) Patent No.: US 7,767,023 B2
(45) Date of Patent: Aug. 3, 2010

(54) DEVICE FOR CONTAINING CATASTROPHIC FAILURE OF A TURBOMOLECULAR PUMP

(75) Inventor: Jeffrey Burgess, Manchester, MA (US)

(73) Assignee: Tokyo Electron Limited, Chandler, AZ (US)

( * ) Notice: Subject to any disclaimer, the term of this patent is extended or adjusted under 35 U.S.C. 154(b) by 496 days.

(21) Appl. No.: 11/691,165

(22) Filed: Mar. 26, 2007

(65) Prior Publication Data

US 2008/0240948 A1 Oct. 2, 2008

(51) Int. Cl.

| | |
|---|---|
| ***C23C 16/00*** | (2006.01) |
| ***F01D 1/36*** | (2006.01) |
| ***F03B 5/00*** | (2006.01) |
| ***F04B 35/04*** | (2006.01) |
| ***C23F 1/00*** | (2006.01) |
| ***H01L 21/306*** | (2006.01) |

(52) U.S. Cl. ..... 118/719; 415/90; 417/423.3; 414/941; 156/345.29

(58) Field of Classification Search ..... 415/90; 417/423.3; 414/941; 118/719; 156/345.29
See application file for complete search history.

(56) References Cited

U.S. PATENT DOCUMENTS 6,206,767 B1 * 3/2001 Suzuki et al. ..... 451/262
6,719,886 B2 * 4/2004 Drewery et al. ..... 204/298.18
6,811,632 B2 * 11/2004 Nelson et al. ..... 156/73.5
2005/0029417 A1 * 2/2005 Scheps et al. ..... 248/201
2005/0047905 A1 * 3/2005 Kabasawa et al. ..... 415/90

* cited by examiner

*Primary Examiner*—Michael Cleveland
*Assistant Examiner*—Keath T Chen
(74) *Attorney, Agent, or Firm*—Oblon, Spivak, McClelland, Maier & Neustadt, L.L.P.

(57) ABSTRACT

A device for containing the catastrophic failure of a vacuum pumping system is described. The vacuum pumping system includes a turbo-molecular pump (TMP) configured to be coupled to a vacuum processing system at an inlet end. The TMP includes a longitudinal axis substantially parallel to an axis of rotation of the TMP and a first lateral axis substantially perpendicular to the longitudinal axis. The vacuum system also includes a containment device configured to mitigate the catastrophic failure of the TMP by impeding only one translational degree of freedom (DOF) and only one rotational DOF of the movement of the TMP. Impeding only one translational DOF includes impeding translational motion of the TMP in a first lateral direction substantially parallel to the first lateral axis. Impeding only one rotational DOF includes impeding rotation of the TMP about the longitudinal axis.

18 Claims, 4 Drawing Sheets

DEVICE FOR CONTAINING CATASTROPHIC FAILURE OF A TURBOMOLECULAR PUMP

FIELD OF THE INVENTION

The present invention relates to a vacuum pumping system, and more particularly to a device for containing the catastrophic failure of a turbo-molecular pump (TMP) in a vacuum processing system.

BACKGROUND OF THE INVENTION

In semiconductor device manufacturing, during the fabrication of integrated circuits (ICs), many process steps in the manufacturing sequence are performed in reduced pressure environments including high vacuum conditions. Generally, these processes, such as etching processes, deposition processes and cleaning processes, require extremely clean or contaminant-free conditions and precise control of the gaseous environment within which the device is processed. Moreover, these reduced pressures are suitable for processing devices using plasma. Often times, for example, plasma is utilized to assist etching reactions or material deposition on a substrate.

In order to achieve high vacuum conditions (of order milliTorr and less), turbo-molecular pumps (TMP) are customarily utilized. Akin to axial flow turbo-machines, TMPs include a plurality of pumping stages, wherein each stage has a rotor blade row (i.e., rotating blades) that is coupled to a common rotatable hub, followed by a stator blade row (i.e., stationary blades) that is coupled to the pump casing. Generally speaking, the operation of a TMP mimics that of a turbomachine in its mechanics with the exception that the design of a TMP is governed by free molecular flow dynamics rather than continuum fluid dynamics. Moreover, in order to deliver suitable pumping speeds to a vacuum processing system, the rotational speed of the TMP rotor is generally in excess of 20,000 to 100,000 RPM (revolutions per minute). In doing so, these pumps can achieve process pressures significantly less than several hundred mTorr (or thousandths of an atmosphere, ATM).

Due to the high rate of rotation of the TMP rotor and the corresponding angular momentum and energy stored in that rotation, there exists a risk that a catastrophic failure of the TMP could lead to a compromise in the coupling of the TMP to the vacuum processing system or possibly a complete detachment of the TMP. If a TMP becomes loose or breaks free of the vacuum process system, the results could be catastrophic. Such a catastrophic failure could include the TMP being carried from the vacuum process system by its angular momentum and dangerous process gasses leaking from the vacuum process system. If a catastrophic failure were to occur, the TMP could damage other parts of the vacuum process system or even injure a vacuum process system operator.

Conventional devices for containing a catastrophic failure of a TMP typically consist of a large base frame that is bolted to the vacuum process system. These conventional devices generally present a large footprint on a tool that includes the vacuum process system, which not only increases costs, but also makes installation or removal of such devices quite complicated. For instance, an operator may have to loosen as many as twenty enormous bolts to gain access to a TMP. Access to the bolts is hampered by the large footprint of the conventional device, which results in a lack of workspace to remove the typically large bolts. Additionally, because the conventional TMP containing devices constrain every degree of freedom a TMP may have, alignment and installation of a TMP to a vacuum process system becomes even more difficult, time consuming, and therefore costly.

SUMMARY OF THE INVENTION

The present invention relates to a device for containing a catastrophic failure of a vacuum pump, such as a turbo-molecular pump (TMP).

According to one embodiment, a device for containing the catastrophic failure of a vacuum pumping system is described. The vacuum pumping system includes a turbo-molecular pump (TMP) configured to be coupled to the vacuum processing system at an inlet end. The TMP includes a longitudinal axis substantially parallel to an axis of rotation of the TMP and a first lateral axis substantially perpendicular to the longitudinal axis. The vacuum system also includes a containment device configured to mitigate the catastrophic failure of the TMP by impeding only one translational degree of freedom (DOF) and only one rotational DOF of the movement of the TMP. Impeding only one translational DOF includes impeding translational motion of the TMP in a first lateral direction substantially parallel to the first lateral axis. Impeding only one rotational DOF includes impeding rotation of the TMP about the longitudinal axis.

According to another embodiment, a vacuum processing system for treating a substrate is described, comprising: a vacuum processing chamber; a substrate holder coupled to the vacuum processing chamber and configured to support the substrate; a process gas supply system coupled to the vacuum processing chamber and configured to introduce a process gas to the vacuum processing chamber in order to facilitate the treatment of the substrate; and a vacuum pumping system comprising a turbo-molecular pump (TMP) configured to be coupled to the vacuum processing system at an inlet end, and a containment device configured to contain a catastrophic failure of the TMP, wherein the containment device restrains only one translational degree of freedom (DOF) and only one rotational DOF of the movement of a TMP in an orthogonal frame of reference.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

In the accompanying drawings.

DETAILED DESCRIPTION OF SEVERAL EMBODIMENTS

In the following description, for purposes of explanation and not limitation, specific details are set forth, such as a particular geometry of the vacuum processing system and descriptions of various components. However, it should be understood that the invention may be practiced in other embodiments that depart from these specific details.

Figure 1:
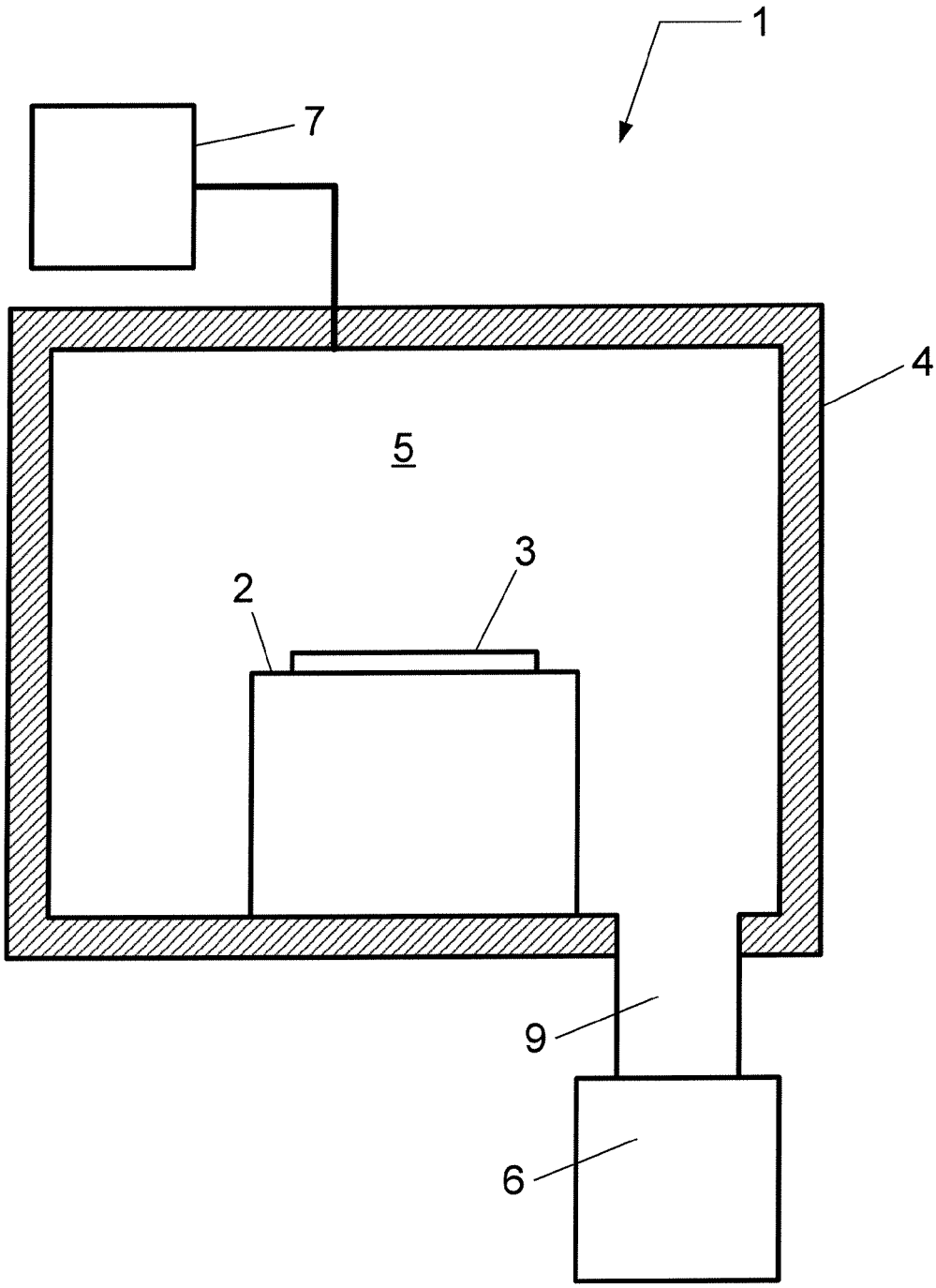
FIG. 1 shows a schematic diagram of a vacuum processing system according to an embodiment.

Referring now to the drawings, wherein like reference numerals designate identical or corresponding parts throughout the several views, FIG. 1 provides a schematic illustration of an example vacuum processing system 1. The example vacuum processing system 1 includes a vacuum processing chamber 4 configured to facilitate the formation of a process environment in process space 5 for treating a substrate 3. In the example, a substrate holder 2 can be coupled to the vacuum processing chamber 4 and can be configured to support substrate 3. A vacuum pumping system 6 coupled to the vacuum processing chamber 4 and configured to evacuate process space 5 through vacuum pumping port 9 can also be included. An example vacuum processing system may be arranged so that a process gas supply system 7 can be coupled to the vacuum processing chamber 4 and configured to introduce a process gas to process space 5. Vacuum processing system 1 may or may not facilitate the generation of plasma to assist the processing of substrate 3.

For example, vacuum processing system 1 can include an etching system, a dry non-plasma etching system, a dry plasma etching system, a deposition system, a chemical treatment system, a thermal treatment system, a dry cleaning system, a vapor deposition system, a chemical vapor deposition (CVD) system, a plasma enhanced CVD (PECVD) system, an atomic layer deposition (ALD) system, a plasma enhanced ALD (PEALD) system, a physical vapor deposition (PVD) system, an ionized PVD (iPVD) system, a rapid thermal processing (RTP) system, or a batch-processing furnace.

Vacuum pumping system 6 can include a turbo-molecular (vacuum) pump (TMP) capable of a pumping speed up to 5000 liters per second (and greater) and a vacuum valve, such as a gate valve or a swing valve, for adjusting the chamber pressure. In conventional vacuum processing devices utilized for semiconductor device manufacturing, a 1000 to 3000 liter per second TMP can be employed. TMPs can be used for low pressure processing, typically less than several hundred mTorr. As an example, the TMP can be a vacuum pump commercially available from Ebara Corporation; BOC Edwards, Inc.; Pfeiffer Vacuum GmbH; Seiko-Seiki; Varian, Inc.; Leybold Vacuum GmbH; etc.

Due to the high rate of rotation of the TMP rotor and the corresponding angular momentum and energy stored in that rotation, there exists a risk that a catastrophic failure of the TMP could lead to a compromise in the coupling of the TMP to the vacuum processing system or possibly a complete detachment of the TMP. Such an event can pose a severe hazard in a manufacturing environment.

Figure 2A:
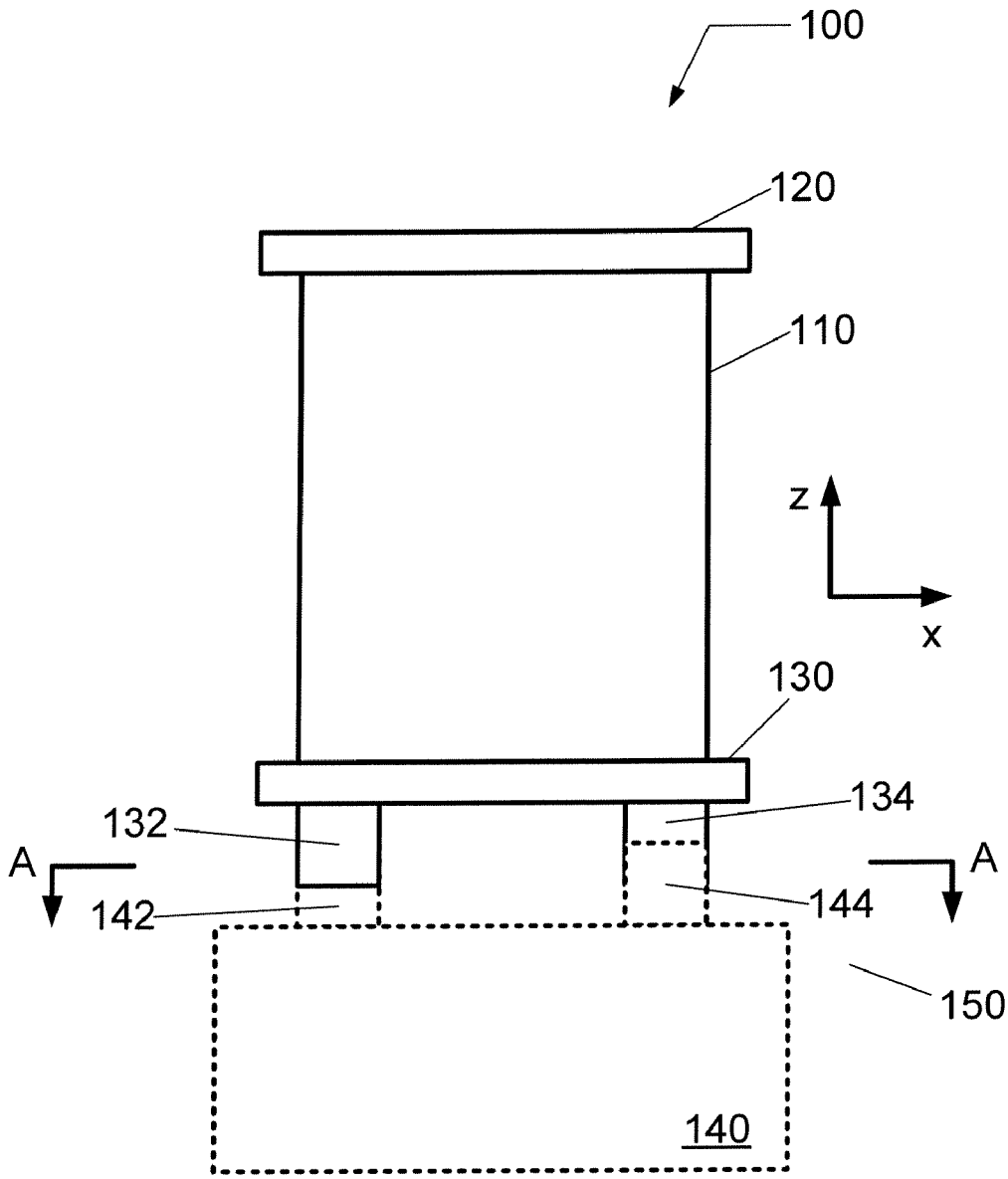
FIGS. 2A through 2C illustrate several views of an example device for containing a catastrophic failure of a vacuum pump.
Figure 2B:
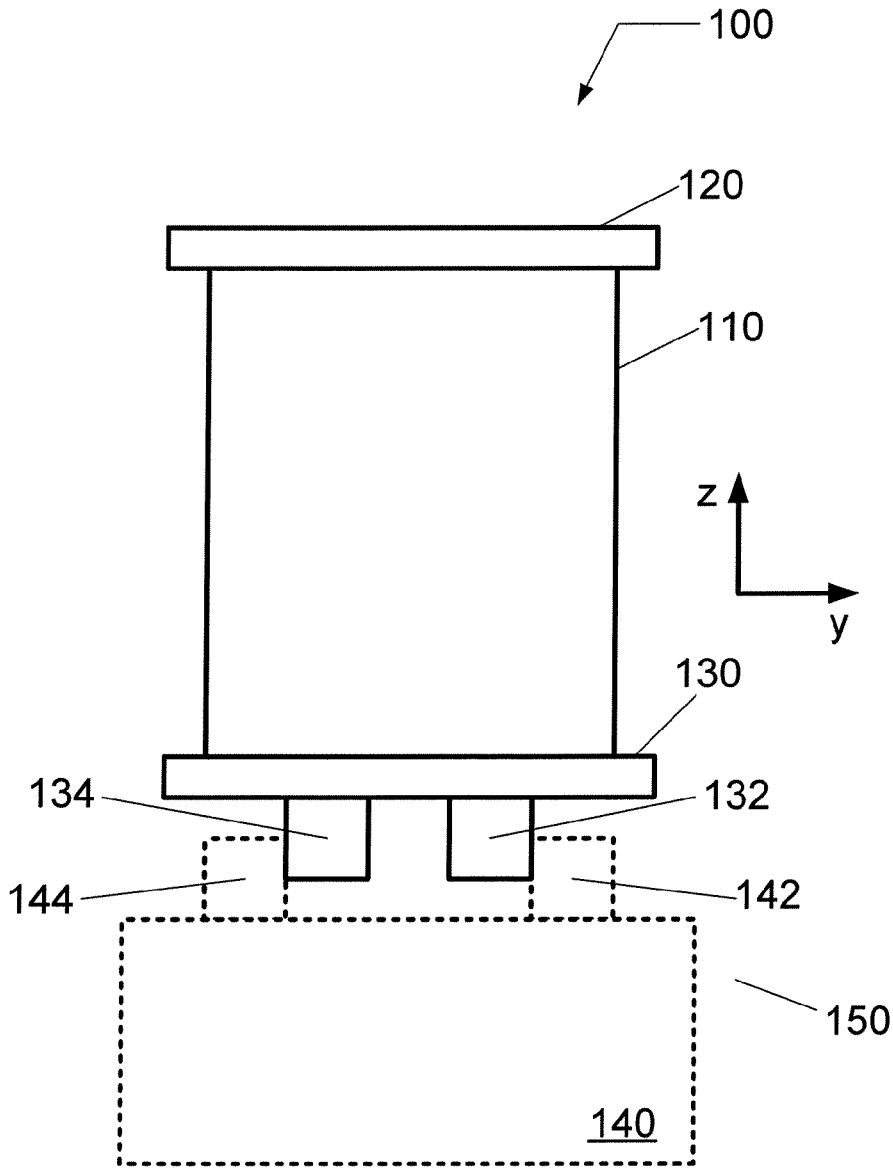
Figure 2C:
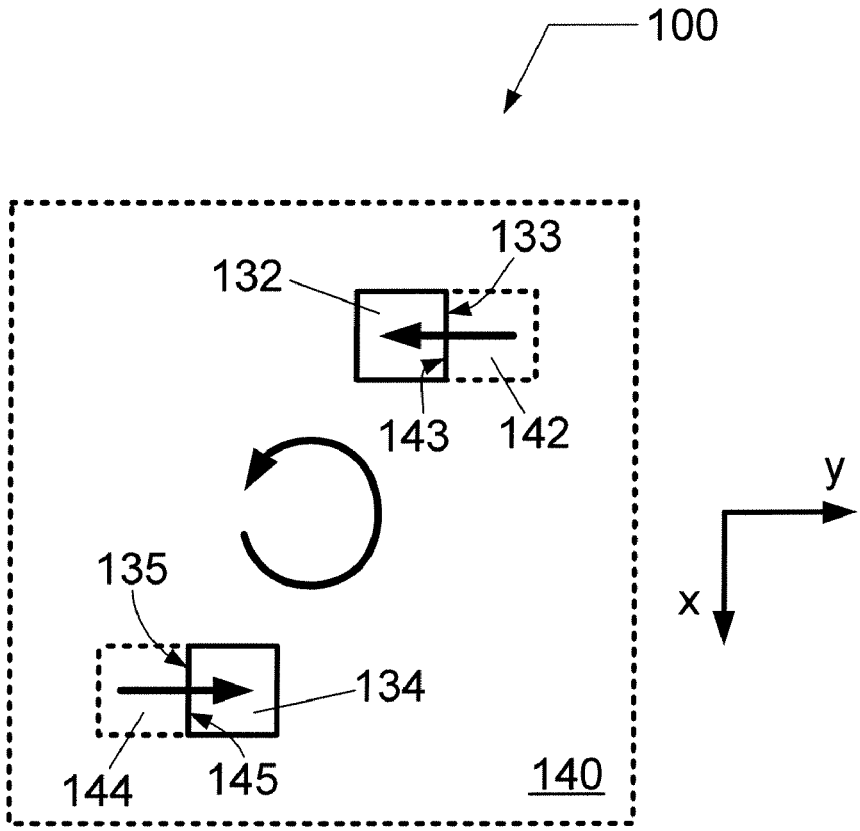

Therefore, according to an example embodiment, a vacuum pumping system configured to mitigate the catastrophic failure of a TMP is described. Referring to FIGS. 2A through 2C, a vacuum pumping system 100 is shown. The vacuum pumping system includes a TMP 110 configured to be coupled to a vacuum processing system at an inlet end 120, and a containment device 150 configured to mitigate the catastrophic failure of the TMP 110. In an orthogonal frame of reference, the containment device 150 is configured to restrain only one translational degree of freedom (DOF) and only one rotational DOF of the movement of the TMP 110.

FIGS. 2A through 2C illustrate an exemplary orthogonal frame of reference, wherein the z-axis is aligned with the axis of rotation of the TMP rotor. The x- and y-axes lie in a lateral plane that is perpendicular to the axis of rotation of the TMP rotor. FIGS. 2A and 2B illustrate orthogonal side views of the vacuum pumping system and FIG. 2C illustrates a plan view of the vacuum pumping system.

Referring still to FIGS. 2A through 2C, the containment device 150 includes a first contact structure 132 and a second contact structure 134 coupled to TMP 110. The first contact structure 132 includes a first contact surface 133, and the second contact structure 134 includes a second contact surface 135. Additionally, the containment device 150 includes an inertial base structure 140, wherein a third contact structure 142 and a fourth contact structure 144 are coupled to the inertial base structure 140. The third contact structure 142 includes a third contact surface 143, and a fourth contact structure 144 includes a fourth contact surface 145. For example, the inertial base structure 140 can include a static frame (or earth-fixed frame) for the vacuum processing system.

The first contact structure 132 and the second contact structure 134 can be attached or fastened to a base plate 130 on TMP 110. Additionally, the third contact structure 142 and the fourth contact structure 144 can be attached or fastened to the inertial base structure 140. For example, a contact structure can be welded to either the base plate 130 on TMP 110 or the inertial base structure 140. Alternatively, for example, a contact structure can be fastened to either the base plate 130 on TMP 110 or the inertial base structure 140 using a bolt to clamp the contact structure, whereby a tapped hole formed in either the base plate 130 or the inertial base structure 140 is configured to receive the bolt. Other arrangements are contemplated and would be understood to one skilled in the art of mechanical design.

Additionally, one of the contact structures can, in one example, be movable relative to the inertial base structure. During installation of the TMP, this adjustable contact structure aids in the alignment of the TMP with both the vacuum processing system and the containment device. For example, the adjustable contact structure can be fastened to either the base plate 130 of TMP 110 or the inertial base structure 140 using a bolt, whereby a slot formed through the adjustable contact structure permits movement of the adjustable contact structure when the bolt is loosened. In another example, more than one of the contact structures is movable relative to the inertial base structure.

The third contact structure 143 and the fourth contact structure 145 are arranged on the inertial base structure 140 in a plane that is perpendicular with the axis of rotation of the rotor in the TMP (i.e., x-y plane). The third contact structure 142 and the fourth contact structure 144 are spaced apart in two orthogonal directions in the x-y plane such that the third contact surface 143 and the fourth contact surface 145 are parallel with one another and are facing directions opposite one another. For instance, the third contact structure 142 and the fourth contact structure 144 are spaced apart in the x-direction and the y-direction, and the third contact surface 143 and the fourth contact surface 145 are oriented such that the normal vector for each surface points in the negative y-direction and the positive y-direction, respectively.

Furthermore, the first contact structure 132 is arranged on a bottom plate 130 of the TMP 110, such that the first contact surface 133 contacts with the third contact surface 143, and the second contact structure 134 is arranged on the bottom plate 130 of the TMP 110 such that the second contact surface 134 contacts with the fourth contact surface 144. When the contact structures are arranged in this manner, the TMP 110 is restrained from translational movement in the y-direction and rotational movement about the z-axis (in a clockwise direction).

Thus, in an orthogonal frame of reference, the containment device 150 is configured to restrain only one translational degree of freedom (DOF) and only one rotational DOF of the movement of the TMP 110. The restraint of only one translational DOF includes impeding the translational movement of TMP 110 in one lateral direction (e.g., x- or y-direction), while not impeding the translational movement of TMP 110 in both the longitudinal direction (i.e., z-axis) and the remaining lateral direction perpendicular to both the axis of rotation of TMP 110 and the impeded lateral direction. For example, as shown in FIGS. 2B and 2C, the translational motion of TMP 110 is impeded in the y-direction. However, as can be seen in FIGS. 2A through 2C, the translational motion of TMP 110 is not impeded in the x-direction or z-direction. During installation of TMP 110, the freedom of movement of TMP 110 in the x- and z-directions eases the alignment and coupling of TMP 110 with the vacuum processing system, for instance.

The restraint of the only one rotational DOF includes impeding the rotational movement of TMP 110 about the longitudinal axis parallel with the axis of rotation of the rotor in TMP 110. For example, as shown in FIGS. 2A through 2C, the impeded rotational movement of TMP 110 about the longitudinal axis parallel with the axis of rotation of the TMP rotor is in the direction of rotation of the rotor in TMP 110 (i.e., clockwise rotation about the z-axis). Optionally, in another example, the impeded rotational movement of TMP 110 about the longitudinal axis parallel with the axis of rotation of the TMP rotor is in the direction of rotation of the rotor in TMP 110 (i.e., clockwise rotation about the z-axis), as well as in the direction of counter-rotation of the TMP rotor (i.e., counter-clockwise rotation about the z-axis).

Furthermore, as illustrated in FIGS. 2A through 2C, the contact structures, i.e., the first contact structure 132, the second contact structure 134, the third contact structure 142 and the fourth contact structure 144, are co-planar and arranged such that each pair of contacting contact structures (i.e., the first contact structure 132 and the third contact structure 142, and the second contact structure 134 and the fourth contact structure 144) have substantially the same moment arm about the axis of rotation of the rotor in TMP 110. In doing so, the application of torque to the containment device 150 will result in substantially the same contact force at each pair of contact structures.

Although only certain embodiments of this invention have been described in detail above, those skilled in the art will readily appreciate that many modifications are possible in the embodiments without materially departing from the novel teachings and advantages of this invention. Accordingly, all such modifications are intended to be included within the scope of this invention.

What is claimed is:

1. A vacuum pumping system, comprising:

a turbo-molecular pump (TMP) configured to be coupled to a vacuum processing system at an inlet end, the TMP including a longitudinal axis substantially parallel to an axis of rotation of the TMP and a first lateral axis substantially perpendicular to the longitudinal axis; and an independent containment device configured to mitigate a catastrophic failure of said TMP by impeding only one translational degree of freedom (DOF) and only one rotational DOF of the movement of said TMP, wherein impeding only one translational DOF includes impeding translational motion of the TMP in a first lateral direction substantially parallel to the first lateral axis, wherein impeding only one rotational DOF includes impeding rotation of the TMP about the longitudinal axis, and wherein the independent containment device does not impede translational motion of the TMP in a second lateral direction that is perpendicular to both the axis of rotation of the TMP and the impeded first lateral direction such that, during installation of the TMP, freedom of movement of the TMP in the second lateral direction eases alignment and coupling of the TMP with the vacuum processing system.

2. The vacuum pumping system of claim 1, said TMP further comprising a second lateral axis substantially perpendicular to the longitudinal axis and substantially perpendicular to the first lateral axis, wherein said impeding only one translational DOF includes not impeding the translational movement of said TMP in a longitudinal direction substantially parallel to the longitudinal axis of a rotor in said TMP and not impeding translational movement of said TMP in a second lateral direction substantially parallel to the second lateral axis.

3. The vacuum pumping system of claim 1, wherein impeding rotation of the TMP about the longitudinal axis comprises impeding rotation of the TMP in a rotational direction of a rotor in said TMP.

4. The vacuum pumping system of claim 3, wherein impeding rotation of the TMP about the longitudinal axis comprises not impeding rotation of the TMP in a counter-rotational direction substantially opposite to the rotational direction of a rotor in said TMP.

5. The vacuum pumping system of claim 1, wherein said containment device comprises:

a first contact structure coupled to said TMP, said first contact structure having a first contact surface;

a second contact structure coupled to said TMP, said second contact structure having a second contact surface;

an inertial base structure;

a third contact structure coupled to said inertial base structure, said third contact structure having a third contact surface; and a fourth contact structure coupled to said inertial base structure, said fourth contact structure having a fourth contact surface, wherein said first contact structure is arranged on said TMP such that said first contact surface contacts with said third contact surface, and said second contact structure is arranged on said TMP such that said second contact surface contacts with said fourth contact surface.

6. The vacuum pumping system of claim 5, wherein said third contact structure and said fourth contact structure are arranged so that said third contact surface and said fourth contact surface are parallel with one another and are facing directions opposite one another.

7. The vacuum pumping system of claim 5, said TMP further comprising a second lateral axis substantially perpendicular to the longitudinal axis and substantially perpendicular to the first lateral axis, wherein said inertial base structure includes a plane defined by said first lateral axis and said second lateral axis, wherein the third contact structure is coupled to the inertial base structure at a first location, and the fourth contact structure is coupled to the inertial base structure at a second location, wherein the first location and the second location are spaced an equal first lateral distance from an axis of rotation of a rotor of the TMP, said first lateral distance measured substantially parallel to said first lateral axis within said plane, wherein the first location and the second location are spaced an equal second lateral distance from the axis of rotation of the rotor of the TMP, said second lateral distance measured substantially parallel to said second lateral axis within said plane, and wherein the first location and the second location are separated within said plane by twice the first distance measured substantially parallel to said first lateral axis within said plane and are separated by twice the second distance measured substantially parallel to said second lateral axis within said plane.

8. The vacuum pumping system of claim 5, wherein one of the contact structures is movable relative to the inertial base structure.

9. The vacuum pumping system of claim 8, wherein the third contact structure and the fourth contact structure are movable relative to the inertial base structure.

10. The vacuum pumping system of claim 8, wherein the first contact structure and the second contact structure are movable relative to the inertial base structure.

11. The vacuum pumping system of claim 5, wherein said inertial base structure comprises a static frame for said vacuum processing system.

12. The vacuum pumping system of claim 5, wherein the TMP includes a bottom plate on an opposite end of the TMP from the inlet end of the TMP, and the first contact structure and the second contact structure extend from the bottom plate of said TMP.

13. A vacuum processing system for treating a substrate, comprising:

a vacuum processing chamber;

a substrate holder coupled to said vacuum processing chamber and configured to support said substrate;

a process gas supply system coupled to said vacuum processing chamber and configured to introduce a process gas to said vacuum processing chamber in order to facilitate said treatment of said substrate; and a vacuum pumping system as recited in claim 1 coupled to said vacuum processing chamber.

14. The vacuum processing system of claim 13, wherein said vacuum processing chamber comprises an etch chamber configured to etch said substrate using a dry plasma etching process or a dry, non-plasma etching process.

15. The vacuum processing system of claim 13, wherein said vacuum processing chamber comprises a deposition chamber configured to deposit a film on said substrate using a vapor deposition process.

16. The vacuum pumping system of claim 1, wherein the containment device is configured to impede only one translational degree of freedom (DOF) and only one rotational DOF of the movement of said TMP by directly contacting said TMP on an opposite side of the TMP from the inlet end of the TMP.

17. A vacuum pumping system, comprising:

a turbo-molecular pump (TMP) configured to be coupled to a vacuum processing system at an inlet end, the TMP including a longitudinal axis substantially parallel to an axis of rotation of the TMP and a first lateral axis substantially perpendicular to the longitudinal axis;

an independent means for impeding only one translational degree of freedom (DOF) of the movement of said TMP; and only one rotational DOF of the movement of said TMP, wherein said only one translational DOF includes translational motion of the TMP in a first lateral direction substantially parallel to the first lateral axis, and wherein said only one rotational DOF includes rotation of the TMP about the longitudinal axis, wherein the independent means for impeding does not impede translational motion of the TMP in a second lateral direction that is perpendicular to both the axis of rotation of the TMP and the impeded first lateral direction such that, during installation of the TMP, freedom of movement of the TMP in the second lateral direction eases alignment and coupling of the TMP with the vacuum processing system.

18. The vacuum pumping system of claim 17, wherein the means for impeding only one translational DOF of the movement of said TMP and the means for impeding only one rotational DOF of the movement of said TMP directly contact said TMP on an opposite side of the TMP from the inlet end of the TMP.

* * * * *